US006400923B1

(12) United States Patent
Fukuda et al.

(10) Patent No.: US 6,400,923 B1
(45) Date of Patent: Jun. 4, 2002

(54) FIXING DEVICE IMPROVED IN OFFSET-PREVENTION

(75) Inventors: Hiromitsu Fukuda, Chiyoda; Toshio Ogiso, Tsuchiura; Masaru Nakano, Tsukuba; Kazuo Kikuchi, Hitachi; Katsumi Kumada, Kitaibaraki; Chikara Hiraoka, Hitachi; Katsuyoshi Onose, Hitachi; Hitoshi Furuyama, Hitachi; Takashi Kakuhashi, Hitachi, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/625,976

(22) Filed: Jul. 26, 2000

(51) Int. Cl.[7] ..... G03G 15/20
(52) U.S. Cl. ..... 399/333; 219/216
(58) Field of Search ..... 399/333, 330, 399/331; 219/216, 469–471

(56) References Cited

U.S. PATENT DOCUMENTS

| | | | | |
|---|---|---|---|---|
| 4,013,871 A | * | 3/1977 | Namiki et al. | 219/471 |
| 4,385,826 A | * | 5/1983 | Itoh | 219/216 X |
| 4,618,639 A | * | 10/1986 | Takahashi et al. | |
| 5,177,549 A | * | 1/1993 | Ohtsuka et al. | |
| 5,659,869 A | * | 8/1997 | Ohtsuka et al. | 399/333 |
| 5,802,440 A | * | 9/1998 | Maeyama | |
| 5,840,457 A | * | 11/1998 | Urawa et al. | |
| 5,995,797 A | * | 11/1999 | Shigeta et al. | |

FOREIGN PATENT DOCUMENTS

| | | | |
|---|---|---|---|
| JP | 58-90671 | * | 5/1983 |
| JP | 59-74578 | * | 4/1984 |
| JP | 4-21884 | * | 1/1992 |
| JP | 4-274473 | * | 9/1992 |
| JP | 4-307579 | * | 10/1992 |
| JP | 8-227243 | * | 9/1996 |
| JP | 11-84932 | * | 3/1999 |

* cited by examiner

*Primary Examiner*—Susan S. Y. Lee
(74) *Attorney, Agent, or Firm*—Antonelli, Terry, Stout & Kraus, LLP

(57) ABSTRACT

A fixing device in an image formation apparatus has a heating roller and a backup roller. These rollers are each coated with single silicone rubber layers around the respective peripheries of their core bars. This silicone rubber has a volume resistance value of $10^{13}$ Ω·cm or more. The heating roller is charged with electricity of the same polarity as the polarity of toner particles due to frictional electrification caused at the time of feeding of a recording medium. The heating and the backup roller are polarized reverse to the polarity of the recording medium. A quantity of charged electricity on the backup roller is made larger than that on the heating roller. This permits the image formation apparatus to prevent offset from occurring at the time of fixing a toner image onto the recording medium to cope with various types of recording media.

19 Claims, 6 Drawing Sheets

FIXING DEVICE IMPROVED IN OFFSET-PREVENTION

BACKGROUND OF THE INVENTION

The present invention relates to an image formation apparatus for forming an image on a recording medium by heating and pressing an unfixed toner image on the recording medium such as recording paper or an OHP film, and particularly, to an image recording apparatus that realizes the stable feeding of a recording medium, whose feeding is difficult, such as thin paper, and thereby can deal with various type of recording media, while preventing the degradation of image quality such as offset and extending the life of a fixing device.

In a conventional image formation apparatus which forms an image with toner particles, as conventional technology concerning a fixing device that can prevent offset by an electric action and deal with various types of recording media, as described in, for instance, JP-A-11-84932, there is a fixing device that has a bias power source for the core metal or core bar of a fixing roller, and applies a voltage from this external power source to the core bar while switching the voltage between the same polarity as a recording medium and the reverse polarity according the timing of feeding of the recording medium.

The above conventional art controls the polarity of the voltage applied to the fixing roller core bar from the bias power source according to the feed timing of a recording medium, in order to prevent offset and feed various types of recording media. With this arrangement, wrapping of the leading end of a recording medium around the fixing roller is prevented by applying the voltage of the same polarity as that of the recording medium when the leading end of the recording medium passes a fixing nip, and the occurrence of offset is prevented by applying the voltage of the reverse polarity to the recording medium, that is, the voltage of the same polarity as that of toner particles, when toner is being fixed.

The arrangement of the above conventional art, however, requires the bias power source for applying the voltage to the fixing roller core bar in order to prevent the occurrence of offset. Further, it is necessary to perform such a control of applying the voltage to the fixing roller core bar and changing the polarity of the voltage according to the feed timing of a recording medium.

SUMMARY OF THE INVENTION

An object of the invention is to prevent the offset at the time of fixing an unfixed toner image which is held on a recording medium by an electric force, and to make it possible to perform the fixing that copes with various types of recording media.

The above object is attainable by each or a combination of the following items (1) to (7).

(1) A pair of fixing rollers each comprise single silicone rubber layers, which have a volume resistance value of $10^{13}$ Ω·cm or more and which are coated around the outer peripheries of their core bars. The surface of one of the pair of fixing rollers, which contacts with an unfixed toner image, is charged with electricity of the same polarity as that of toner particles due to frictional electrification caused during feeding of a recording medium. This construction provides an electric repulsive force for preventing the occurrence of offset.

(2) In the above-described item (1), the pair of fixing rollers forms a nip where the fixing roller contacting with the unfixed toner image has a concave shape. This causes a recording medium to be discharged along the fixing roller on which on image is formed, to enable the stable feeding of the recording medium.

(3) The pair of fixing rollers are provided with the single silicone rubber layers, whose volume resistance value is not less than $10^{13}$ Ω·cm, coated around the respective peripheries of their core bars, so that they are charged with electricity of the reverse polarity to that of the recording medium due to frictional electrification caused at the time of the feeding of the recording medium.

(4) The pair of fixing rollers are polarized reverse to the recording medium due to frictional electrification caused during the feeding of the recording medium. An absolute value of the quantity of charged electricity is made smaller at the roller contacting with the unfixed toner image than at the roller on the other side. Such magnitude correlation of the charged electricity quantity ensures that the recording medium is discharged along the roller on the non-image formation side, and the feeding of the recording medium becomes stable.

(5) The pair of fixing rollers in the items (3) and (4) form a nip, and at this nip, the fixing roller contacting with the unfixed toner image is in a concave shape.

(6) In the arrangement according to any of the items (1) to (5), a separation pawl is provided on one of the fixing roller pair, which contacts with the non-image formation side of the recording medium. This makes it possible to perform the further stable feeding of the recording medium.

Furthermore, an image formation apparatus for attaining the above object according to the invention comprises a photosensitive member for forming thereon an electrostatic latent image by a signal from a host system, a development device for developing the electrostatic latent image on the photosensitive member and forming a toner image, a transfer device for transferring the developed toner image to a recording medium, and a fixing device for introducing the recording medium, to which the toner image has been transferred, between a pair of fixing rollers to fix the toner image on the recording medium. The pair of fixing rollers each have single silicone rubber layers coated around the outer peripheries of their core bars, which have a volume resistance value of $10^{13}$ Ω·cm or more.

In addition, the above-described image formation apparatus of the invention is constructed so that a surface of the fixing roller contacting with the unfixed toner image is charged with electricity of the same polarity as that of the toner particles supplied by the development device.

DESCRIPTION OF THE EMBODIMENTS

The embodiments of the invention will be now described.

Figure 7:
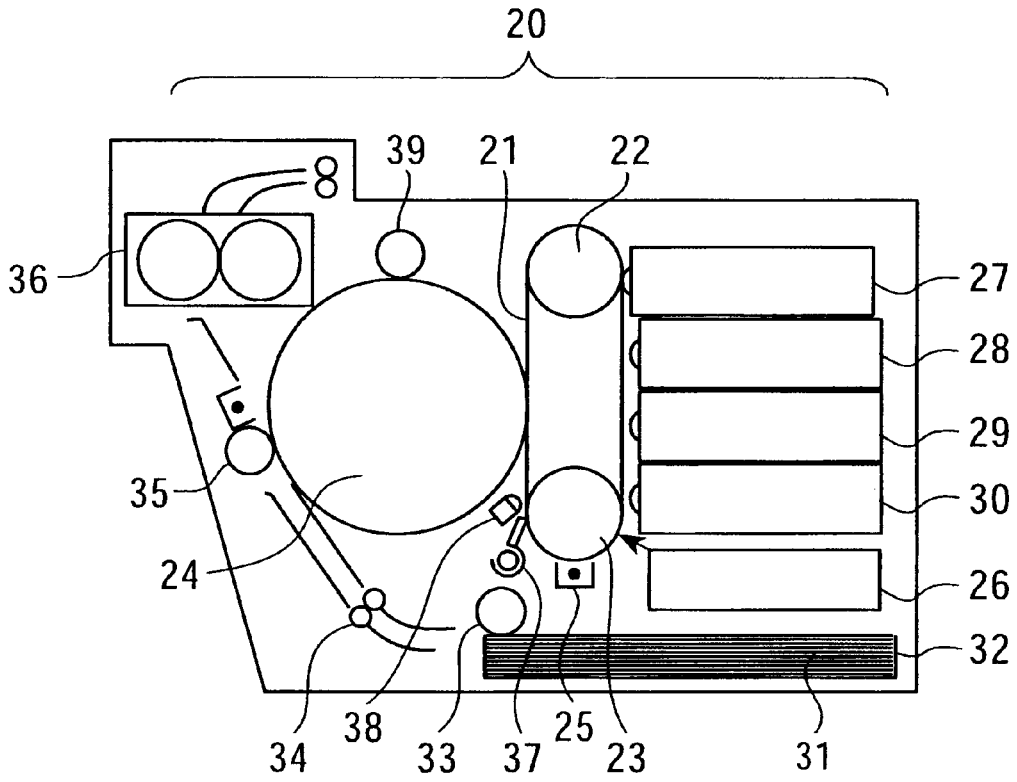
FIG. 7 is a conceptual view for explanation of the construction of an image formation apparatus to which the invention is applied.

FIG. 7 is a view showing the general construction of an image formation apparatus 20 to which the invention is applied. The image formation apparatus 20 that is illustrated in this figure is just an example. The invention is not limited to the image formation apparatus 20 of the construction shown in this figure but may be embodied in the image formation apparatus of another construction as far as it brings the same effects.

In FIG. 7, a photosensitive member belt 21, on which an electrostatic latent image is formed, is stretched vertically and rotates at a constant speed in the direction shown by an arrow, by a drive roller 22, driven by drive means not shown, and a driven roller 23 that also serves as a tension roller for imparting tension to the belt 21. The photosensitive member belt 21 contacts with an intermediate transfer member 24 to which a toner image formed on the photosensitive member belt 21 is transferred.

The surface of the photosensitive member belt 21 is uniformly electrified by a charger 25. When a print signal is sent from an information processing unit which is not shown, a laser beam corresponding to a toner image is applied from an exposure device 26 onto the surface of the photosensitive member belt 21 in response to the signal, and an electrostatic latent image is formed.

The electrostatic latent image on the surface of the photosensitive member belt 21 is formed for every color of development devices 27, 28, 29, and 30. The four development devices 27, 28, 29, and 30 are arranged along a vertical surface of the photosensitive member belt 21, apply electric charge to toner particles, develop the respective electrostatic latent images, and form the toner images.

The toner images of the respective colors formed on the surface of the photosensitive member belt 2 are transferred to the surface of the intermediate transfer member 24 through contacting with the latter, and are held on the surface of the intermediate transfer member 24 while retaining the electric charge.

The four-colored toner images, which are thus formed on the surface of the intermediate transfer member 24 in a superimposed manner, are transferred to a recording medium 31 such as a sheet of recording paper. The recording medium 31 is fed by a paper feeding roller 33 from a paper cassette 32 in which recording media 31 are contained, and is adjusted its posture for transport by resist rollers 34. Then, the recording medium 31 is fed between the intermediate transfer roller 24, holding the toner images on its surface, and a transfer roller 35 for transferring the toner images to the recording medium 31, and the toner images are transferred. When the toner images are transferred, a potential by which the toner images are easily transferred is given from the intermediate transfer roller 24 to the transfer roller 35.

The recording medium 31, on which the toner images unfixed have been transferred, is fed to a fixing device 36 including a pair of fixing rollers. Then, the toner images are fixed, and the recording medium 31 is discharged from the apparatus 20.

After the toner images are transferred from the surface of the photosensitive member belt 21 to the intermediate transfer member 24, a blade 37 removes toner particles remaining on the surface of the photosensitive member belt 21. An erase lamp 38 removes electric charges remaining on the surface of the photosensitive member belt 21. In addition, after the toner images are transferred from the intermediate transfer member 24 to the transfer material, a cleaner 39 removes toner particles remaining on the surface of the intermediate transfer member 24.

Figure 1:
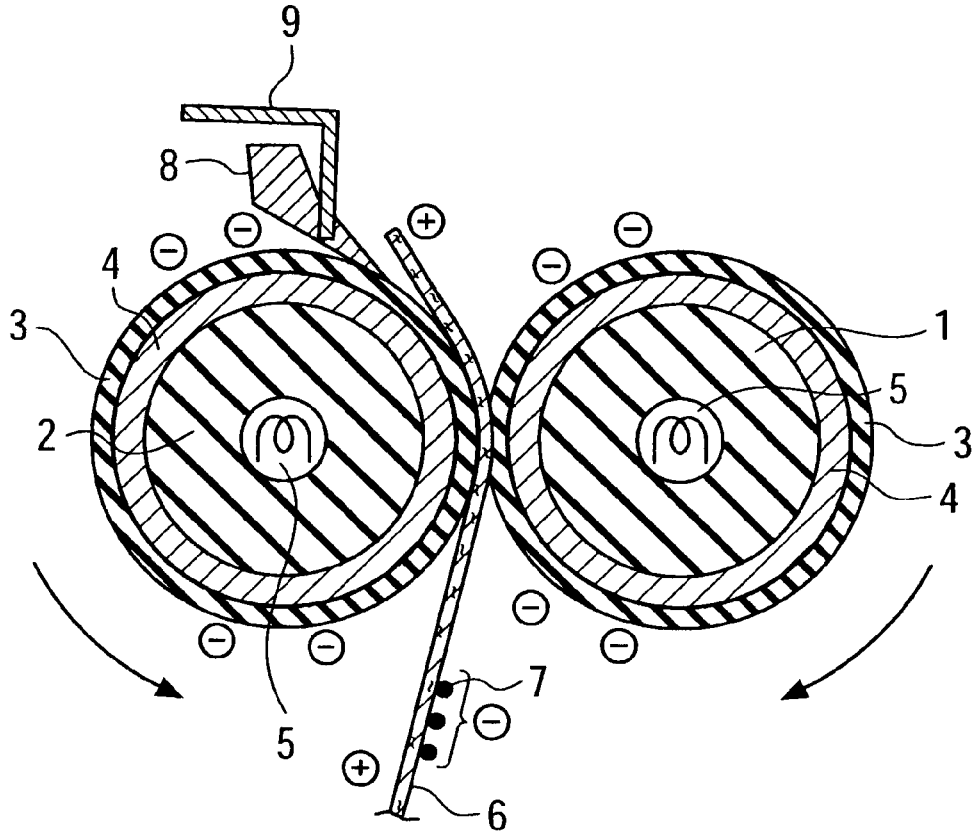
FIG. 1 is a section view showing the general construction of a fixing device according to the first embodiment of the invention.

As the most preferable embodiment of the invention, the fixing device to which the invention is applied in the above-described image recording apparatus will be described in detail. FIG. 1 is a view showing the general construction of the fixing device according to the embodiment, to which the invention is applied.

The fixing device according to the embodiment of the invention has a heating roller 1 serving as one of the fixing rollers and a backup roller 2 serving as the other fixing roller. The heating roller is located on a side of contacting with toner particles 7 that are attached to a recording medium 6 by an electric force, that is, on an image formation side. The backup roller 2 faces the heating roller 1, is given a constant pressing force and is pushed to the heating roller 1.

The heating roller 1 and the backup roller 2 each have a structure that a rubber layer 3 made of a single material is coated around a core bar 4. Those rollers 1 and 2 each have therein halogen lamps 5 serving as heat sources. As the material of the rubber layer 3, silicone rubber is used for both the rollers because of heat resistance, releasing property from toner particles 7, etc. This silicone rubber contains a less quantity of additives such as carbon and the like that give conductivity, so that its volume resistance value becomes $10^{13}$ Ω·cm or more.

In addition, the configuration of a nip or contact portion between the heating roller 1 and the backup roller 2 is designed as follows. The heating roller 1 is made to have a softer rubber hardness than that of the backup roller 2 so as to cause the rubber of the heating roller 1 to become concave at this nip to form a recording medium feed path in which the recording medium 6 is discharged toward the backup roller 2.

On the side of the backup roller 2, a separation pawl 8 and a paper discharge guide 9 are installed. Accordingly, if the recording medium 6 is discharged while wrapping around the backup roller 2, it is possible to surely separate the recording medium 6 from the backup roller 2 and to stably feed the recording medium 6.

Subsequently, a series of operations in the fixing process by the fixing device constructed with the application of the invention will be described.

The recording medium 6, on which the toner particles 7 are held with electric adhesion, is fed to the nip between the heating roller 1 and the backup roller 2, and the fixing is performed.

In this embodiment, the recording medium and the toner after the transfer, which is a prior step of the fixing in an electro photographic process, are in the charged condition wherein the recording medium 6 is positively electrified and the toner particles 7 are negatively electrified. In contrast, the heating roller 1 and the backup roller 2 are negatively electrified due to the frictional electrification caused at the time of feeding of the recording medium 6, because their volume resistance values are $10^{13}$ Ω·cm or more.

The toner particles 7 and the heat roller 1 contacting with the former are polarized identical and repel each other to prevent the toner particles 7 from sticking to the heating roller 1. In other words, the occurrence of offset is prevented.

On the other hand, the recording medium 6 is polarized reverse to both the rollers, and electric adhesion occurs between both the rollers. Nevertheless, because of the electric repulsion between the toner 7 and the heating roller 1 and because of the convex shape of the nip toward the heating roller 1, the recording medium 6 is discharged toward the backup roller 2 near the exit of the nip. The recording medium 6, even when discharged while sticking to the backup roller 2, is peeled off by the separation pawl 8, and is fed along the paper discharge guide 9.

With this construction, it becomes possible to prevent a recording medium from wrapping around the heating roller 1 which badly affects image quality, and to realize a stable recording medium feeding system for various types of recording media.

Moreover, the heating roller 1 and the backup roller 2 have such a magnitude relation between their electric charge quantities that the quantity of electric charge between the backup roller 2 and the recording medium 6 is larger than that between the heating roller 1 and the recording medium 6. This makes it possible to perform further stable recording medium feeding. The electric adhesion from the rollers to the recording medium 6 has a large influence particularly when the recording medium 6 is a generally-called thin paper or a sheet of paper whose weight is 55 $g/m^2$ or less. Accordingly, it is important for the stable feeding of the thin paper to form the nip in the above-described shape to thereby stably and surly discharge the paper toward the backup roller. The quantity of electric charge may vary by changing the proportion of additives added to the rubber material. For example, there are additives such as quartz powder and calcium carbonate. These materials are insulative, and with the quantities of the additives added, the volume resistance value of the rubber varies to control the quantity of electric charge.

Figure 2:
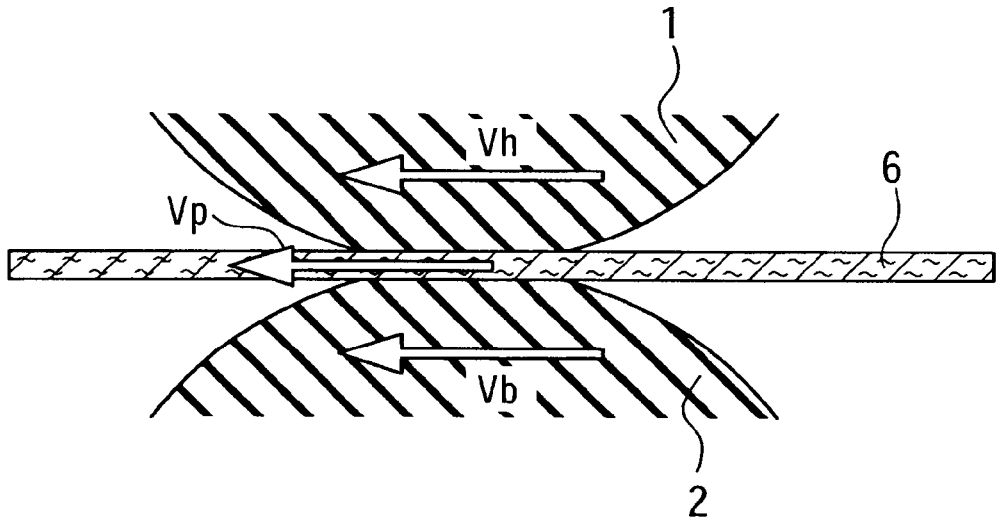
FIG. 2 is an enlarged view of a nip at the time of feeding of a recording medium.

As for a mechanism of the frictional electrification, it is conceivable that rubber is frictionally electrified by a minute slip between the rubber and the recording medium, that is, by a speed difference occurring due to a change in the shape of the rubber. For example, as shown in FIG. 2, representing the feeding speed of the recording medium 6 nipped and fed between the heating roller 1 and the backup roller 2 by Vp, the feeding speed of the heating roller 1 by Vh, and the feeding speed of the backup roller 2 by Vb, there is the relation $Vp>Vh\approx Vb$ in general. This relation holds in such a case that any one of the heating roller 1 and the backup roller 2 is a driver and the other is driven through the frictional contact.

On the other hand, it is considered as a method of actively generating the speed difference that both the rollers have radius different from each other and are drivers.

In addition, as for the surface roughness of the rollers (measured with a contact type surface roughness meter), it is desirable from the viewpoint of image quality that the heating roller 1 is smoother than the backup roller, and in particular, it is desirable that Ra is 0.5 $\mu$m or less. Further, it is desirable from the viewpoint of the feeding property of a recording medium or an OHP film that the backup roller 2 is rougher than the heating roller 1, and in particular, it is desirable that Ra is 0.3 $\mu$m or more.

Figure 3:
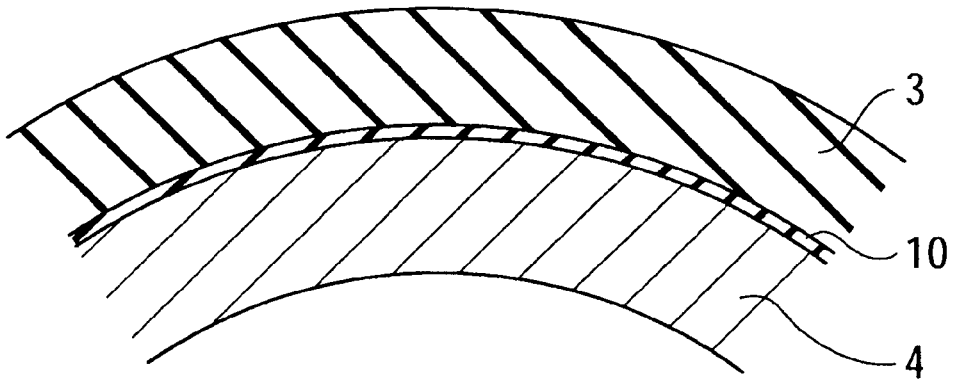
FIG. 3 is an enlarged section view of a rubber roller.

FIG. 3 is an enlarged view of the roller coated with single silicone rubber material. The single silicone rubber is defined as rubber composed of one kind of rubber (rubber in which fillers and plasticizers or the like are combined) that is poured when a roller is molded, and an adhesion layer 10 on the core bar 4 is not included in this definition. In addition, regarded also as the single silicone rubber meant in the invention are rubber in which the pure rubber and additives such as fillers naturally separate into layers formed on a top surface and a bottom surface during the process of rubber vulcanization, and rubber in which there is the concentration distribution of oil between a top surface and bottom surface due to oil impregnation after the molding.

Figure 4:
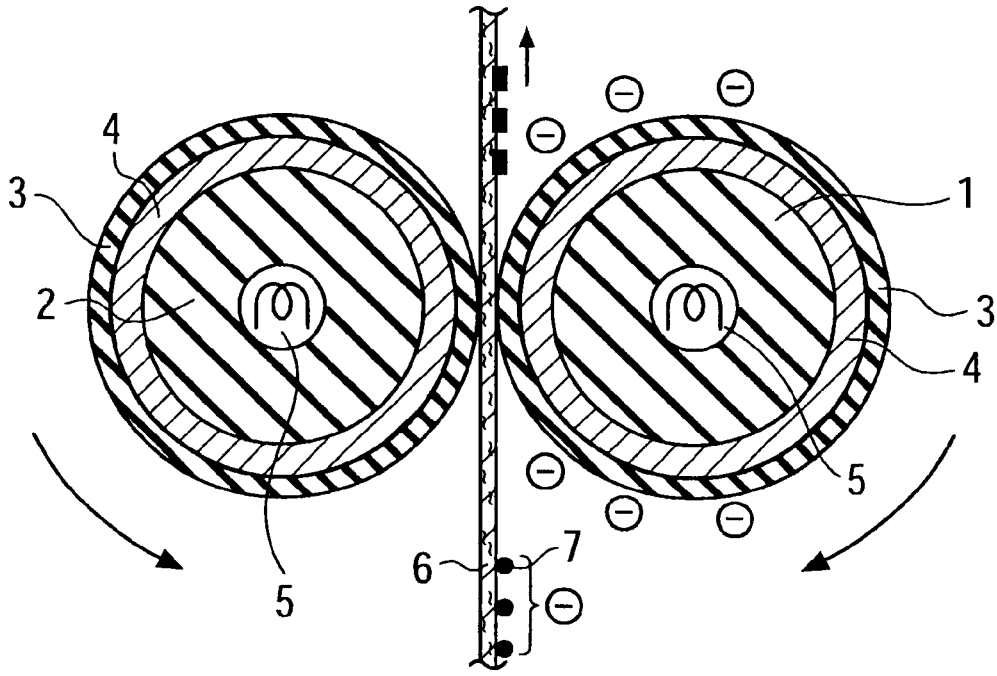
FIG. 4 is a section view showing the general construction of a fixing device according to the second embodiment of the invention.

Next, the second embodiment of the invention will be described. As shown in FIG. 4, the second embodiment is such a case that the heating roller 1 is not in a concave shape in the nip.

The construction shown in FIG. 4 is that the rubber hardness difference between the heating roller 1 and the backup roller 2 is 10 degrees or less, so that the shape of the nip becomes almost flat. The recording medium 6, after passing through the nip, is discharged in a tangential direction without being affected by the adhesion caused by the electric charge of both the rollers. It is the requirement for enabling such discharge that the rigidity of the recording medium 6 is larger than the adhesion by the electric charge of the roller surfaces. A recording medium, which has a weight of about 55 $g/m^2$ or more and is generally called regular or plain paper, is considered to satisfy this requirement.

In such a case of particularly using no thin paper, there is no fear of its wrapping around the rollers in contrast to the first embodiment described above, and the separation pawl becomes unnecessary. Furthermore, it is possible to have such an effect that large margins of the shape, the positional accuracy, etc. of a guide forming a peripheral feeding path for a recording medium can be afforded.

In regard to the offset prevention, similarly to the first embodiment, the heating roller 1 and toner particles 7 are electrified in the same polarity, and therefore, it is possible to prevent the toner particles 7 from attaching to the heating roller 1.

Next, the third embodiment will be described with reference to FIG. 5.

Figure 5:
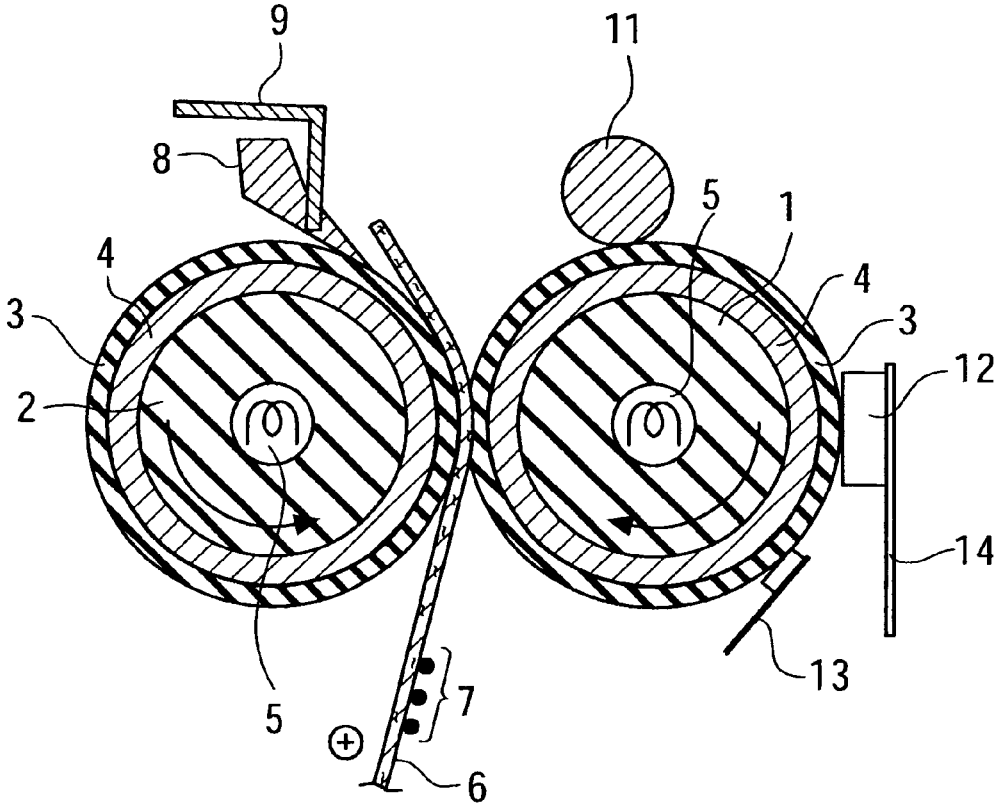
FIG. 5 is an explanatory view for explanation of the third embodiment wherein a cleaning mechanism and an oiling mechanism are installed in the fixing device of FIG. 1.

FIG. 5 is a view for explaining the other embodiment of the invention where a cleaning roller 11, an oil felt 12, and a blade 13 are installed on the outer periphery of the heating roller 1. The cleaning roller 11 is for cleaning minute offset toner particles sticking to the heating roller 1, and has a construction for rotating in contact with the heating roller 1 with a difference in the peripheral speed from that of the heating roller 1.

The oil felt 12 is for applying a mold release agent such as silicone oil to the outer peripheral surface of the heating roller 1 so as to stably secure the releasing property of the heating roller 1 to the toner 7, and is pressed to the heating roller 1 by a flat spring 14. The blade 13 functions to make the release agent uniform without unevenness, which has been applied by the oil felt 12, and scrape excessive oil to keep the amount of oil application constant.

With the provision of these cleaning mechanism and oiling mechanism, it becomes possible to increase the margin for the offset and to prolong the life of the fixing device.

Figure 6:
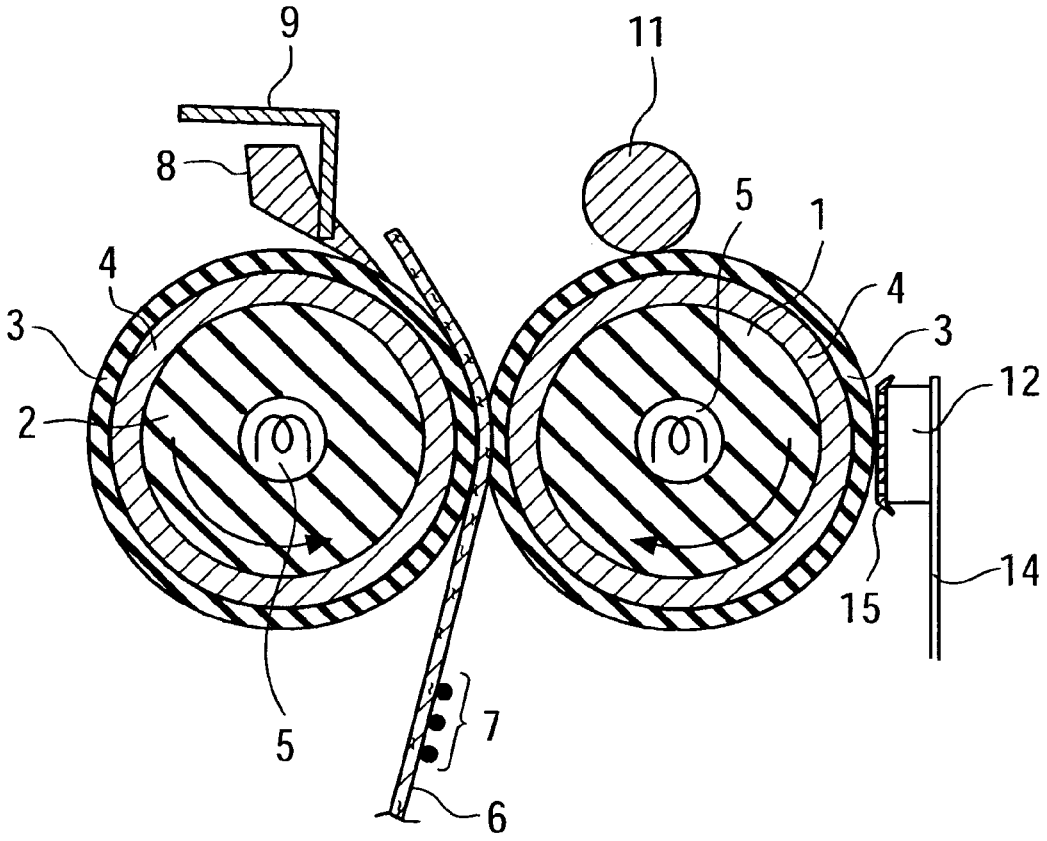
FIG. 6 is an explanatory view for explanation of the fourth embodiment wherein a porous sheet is attached to the oiling mechanism of the fixing device of FIG. 5.

FIG. 6 shows the fourth embodiment where a porous sheet 15 is bonded to the surface of the oil felt 12 shown in FIG. 5. It is possible to regulate the amount of oil application with the diameter of holes in this porous sheet 15, to apply the mold release agent such as silicone oil uniformly without unevenness, and to scrape excessive oil to keep the amount of oil application constant. Accordingly, the blade 13 is not required.

The porous sheet 15 is made of a material, for example, PTFE (polytetrafluoroethylene). Such a porous sheet is good at sliding on the heating roller 1, and its use enables the application of a constant quantity of oil without scratching the roller surface.

In the third and fourth embodiments, various mechanisms such as the cleaning mechanism and the oiling mechanism are installed near the heating roller 1. Accordingly, it is conceivable that these mechanisms affect the electrification system. Nevertheless, in the actual measurement of electrified potential on the roller surface, the electrified polarities of the toner particles 7 and the heating roller 1 by the frictional electrification were the same, and the recording medium 6 and both the rollers were polarized reverse to each other. This is because the frictional electrification occurs near the nip, and it is supposed that conceivable that this shows that the electrification system is not affected by the peripheral mechanisms at the time of paper feeding.

As described above, according to the embodiments of the invention, the fixing device used in an image formation apparatus is so constructed that at least the surface of the heating roller is charged with electricity of the same polarity as that of toner particles due to the frictional electrification when heating and pressing unfixed toner particles, which are held on a recording medium with an electrical force, by the pair of fixing rollers while feeding the recording medium. This causes an electric repulsive force to act between the toner particles and the heating roller and to prevent the offset. In addition, by using this with the cleaning mechanism and the oiling mechanism, it becomes possible to increase the margin for the offset.

Furthermore, according to the embodiments of the invention, the recording medium and the backup roller are polarized reverse to each other by the frictional electrification at the time of the feeding of the recording medium. This permits utilizing an electric adsorption force to the roller and provides a feeding path in which a recording medium is discharged toward the backup roller. This construction makes it possible to stabilize the behavior of recording medium feeding and may cope with various types of recording media. In addition, the shape of the nip, which is formed by the heating roller and the backup roller, is concave toward the heating roller, and therefore the margins increase.

Moreover, with the above-described construction, the fixing device can prevent the offset and cope with various types of recording media without using an external power source for applying a voltage to the core bars and without controlling the timing of voltage application and the polarity.

According to the invention, the prevention of offset at the time of fixing an unfixed toner image held on a recording medium with an electric force, and the fixing coping with various types of recording media can be realized.

What is claimed is:

1. A fixing device for heating and pressing an unfixed toner with a pair of rollers in contact with each other, which toner is held on a recording medium, while feeding the recording medium, wherein each of said pair of rollers having a silicone rubber layer coated around an outer periphery of the roller, and said silicone rubber layer having a volume resistance value of $10^{13}$ Ωcm or more.

2. The fixing device according to claim 1, wherein a surface of one of said pair of rollers, which contacts with the unfixed toner, is charged with electricity of the same polarity as a polarity of the toner during feeding of the recording medium.

3. A fixing device for heating and pressing an unfixed toner image with a pair of fixing rollers, which image is held on a recording medium by an electric force, while feeding the recording medium, wherein each of said pair of fixing rollers comprises a core bar and a single silicone rubber layer coated around an outer periphery of said core bar, said silicone rubber layer having a volume resistance value of $10^{13}$ Ω·cm or more, so that surfaces of said pair of fixing rollers are charged with electricity of a reverse polarity to a polarity of the recording medium due to frictional electrification caused during feeding of the recording medium.

4. The fixing device according to claim 3, wherein said pair of rollers form a nip, and the roller contacting with the unfixed toner is in a concave shape at said nip.

5. The fixing device according to claim 3 or 4, wherein one of said pair of rollers, which contacts with a side of the recording medium where no toner image is formed, is provided with a separation pawl.

6. A fixing device for heating and pressing an unfixed toner image with a pair of fixing rollers, which image is held on a recording medium by an electric force, while feeding the recording medium, wherein each of said pair of fixing rollers comprises a core bar and a single silicone rubber layer coated around an outer periphery of said core bar, said silicone rubber layer having a volume resistance value of $10^{13}$ Ω·cm or more, so that surfaces of said pair of fixing rollers are charged with electricity of a reverse polarity to a polarity of the recording medium due to frictional electrification caused during feeding of the recording medium, an absolute value of a quantity of charged electricity being smaller at the fixing roller contacting with the unfixed toner image than at the other fixing roller.

7. The fixing device according to claim 6, wherein said pair of rollers form a nip, and the roller contacting with the unfixed toner is in a concave shape at said nip.

8. The fixing device according to claim 6 or 7, wherein one of said pair of rollers, which contacts with a side of the recording medium where no toner image is formed, is provided with a separation pawl.

9. An image formation apparatus comprising a photosensitive member for forming an electrostatic latent image by a signal from a host system, a development device for developing the electrostatic latent image on said photosensitive member and forming a toner image, a transfer device for transferring the developed toner image to a recording medium, and a fixing device for introducing the recording medium, to which the toner image has been transferred, between a pair of fixing rollers to fix the toner image on the recording medium, each of said pair of fixing rollers including a core bar and a single silicone rubber layer provided around an outer periphery of said core bar, said silicone rubber layer having a volume resistance value of $10^{13}$ Ω·cm or more.

10. The image formation apparatus according to claim 9, wherein a surface of the fixing roller contacting with an unfixed toner image is charged with electricity of the same polarity as a polarity of toner particles supplied by said development device.

11. A fixing device for heating and pressing an unfixed toner with a pair of rollers in contact with each other, which toner is held on a recording medium, while feeding the recording medium, wherein a nip formed by said pair of rollers contacting with each other is in a shape concave in one of said pair of rollers contacting with an unfixed toner, and wherein each of said pair of rollers has a silicon rubber layer coated on an outer periphery of the roller with a volume resistance value of $10^{13}$ Ωcm or more.

12. The fixing device according to claim 11, wherein said pair of rollers have different diameters and are provided with drive means for driving said pair of rollers.

13. An image formation apparatus, comprising:

a photosensitive member for forming an electrostatic latent image on a surface;

a development device for developing the electrostatic latent image on the photosensitive member and forming a toner image;

a transfer device for transferring the toner image to a recording medium; and fixing means for introducing the recording medium, to which the toner image has been transferred, between a pair of rollers to fix the toner image on the recording medium, wherein each of said rollers includes a silicone rubber layer coated on an outer periphery with a volume resistance value of $10^{13}$ Ωcm or more, and wherein a nip formed by said pair of rollers contacting with each other is in a shape concave in one of the pair of rollers contacting with the unfixed toner.

14. The image formation apparatus according to claim 13 wherein one of said pair of rollers, which contacts with a side of the recording medium where no toner image is formed, is provided with a separation pawl.

15. The image formation apparatus according to claim 14, wherein a surface of one of said rollers, which contacts with the unfixed toner, is charged with electricity of the same polarity as a polarity of the toner during feeding of the recording medium.

16. The image formation apparatus according to claim 14, wherein said pair of rollers having different diameters and are provided with drive means for driving said pair of rollers.

17. An image formation apparatus, comprising:

a photosensitive member for forming an electrostatic latent image on a surface;

a development device for developing the electrostatic latent image on the photosensitive member and forming a toner image;

a transfer device for transferring the toner image to a recording medium, and fixing means for introducing the recording medium, to which the toner image has been transferred, between a pair of rollers to fix the toner image on the recording medium, wherein each of said rollers includes a silicone rubber layer coated on an outer periphery with a volume resistance value of $10^{13}$ Ωcm or more, and wherein a nip formed by said pair of rollers contacting with each other is in a shape concave in one of the pair of rollers contacting with an unfixed toner so that the recording medium is discharged from the pair of rollers.

18. The image formation apparatus according to claim 17 wherein one of said pair of rollers, which contacts with a side of the recording medium where no toner image is formed, is provided with a separation pawl.

19. The image formation apparatus according to claim 17, wherein a surface of one of said rollers, which contacts with the unfixed toner, is charged with electricity of the same polarity as a polarity of the toner during feeding of the recording medium.

* * * * *

UNITED STATES PATENT AND TRADEMARK OFFICE

CERTIFICATE OF CORRECTION

PATENT NO. : 6,400,923 B1
DATED : June 4, 2002
INVENTOR(S) : Fukuda et al.

It is certified that error appears in the above-identified patent and that said Letters Patent is hereby corrected as shown below:

Title page,
Item [30], Foreign Application Priority Data should read:
-- Jul. 30, 1999 (JP) ……..11-216357 --

Signed and Sealed this

Ninth Day of November, 2004

JON W. DUDAS
*Director of the United States Patent and Trademark Office*